United States Patent [19]

Keller

[11] 4,018,293

[45] Apr. 19, 1977

[54] METHOD AND APPARATUS FOR CONTROLLED FRACTURING OF SUBTERRANEAN FORMATIONS

[75] Inventor: Leonard J. Keller, Dallas, Tex.

[73] Assignee: The Keller Corporation, Dallas, Tex.

[22] Filed: Jan. 12, 1976

[21] Appl. No.: 648,136

[52] U.S. Cl. ..... 175/4.5; 102/24 HC; 166/63; 166/299; 166/308; 175/4.6

[51] Int. Cl.² ..... E21B 43/117

[58] Field of Search ..... 102/24 HC; 166/63, 299, 166/308, 55, 55.2; 175/4.5

[56] References Cited

UNITED STATES PATENTS

| | | | |
|---|---|---|---|
| 2,831,429 | 4/1958 | Moore | 102/24 HC |
| 2,839,997 | 6/1958 | Church et al. | 102/24 HC |
| 2,935,020 | 5/1960 | Howard et al. | 102/24 HC |
| 2,988,143 | 6/1961 | Scotty | 166/299 |
| 3,242,987 | 3/1966 | Lebourg | 166/299 |

*Primary Examiner*—Ernest R. Purser
*Attorney, Agent, or Firm*—James C. Fails

[57] ABSTRACT

Method and apparatus for controlled fracturing of a portion of the earth's formations intermediate predetermined depths characterized by positioning adjacent the portion to be fractured explosive charges having exteriorly disposed grooves deep enough to effect a concentration of explosive forces along a predetermined fracture plane, the plane extending radially outwardly from the central longitudinal axis of the groove; and detonating the explosive charge to achieve the desired fracture. Preferred embodiments employ both horizontally-fracturing explosive charges containing peripherally disposed grooves having their central longitudinal axis in a plane perpendicular to the central longitudinal axis of the explosive charge and vertically-fracturing charges having longitudinally extending grooves so as to fracture outwardly in planes that are substantially vertically oriented and passed through the center line of the charge. Also disclosed are additional shapes of charges for effecting specific results, as well as the other elements and apparatus necessary for effecting detonation of the charges.

11 Claims, 14 Drawing Figures

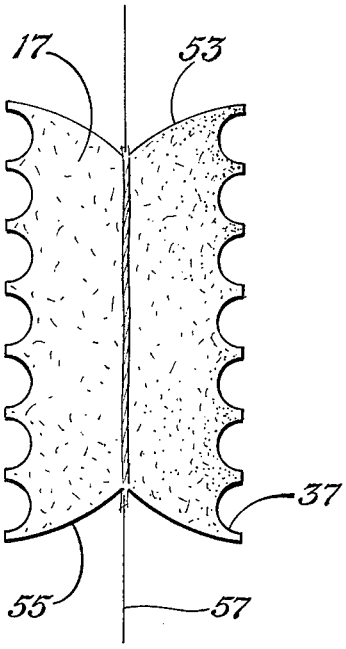
Fig. 7
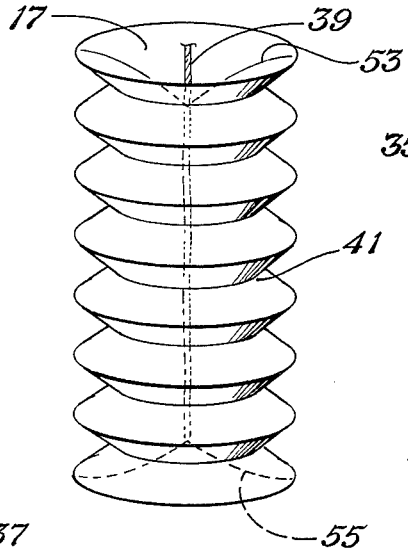
Fig. 5
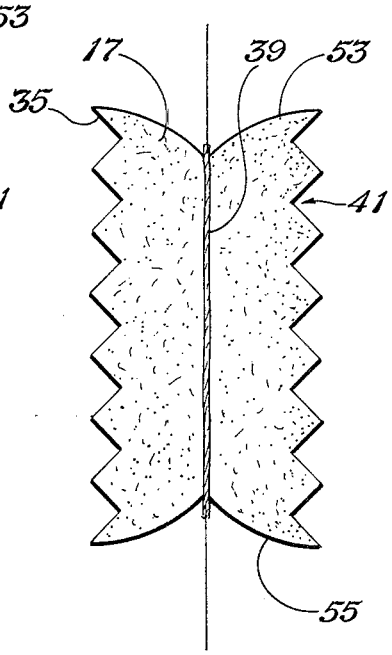
Fig. 6
Fig. 7A
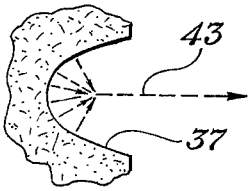
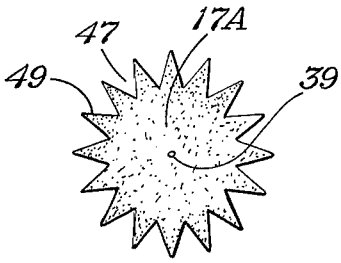
Fig. 9
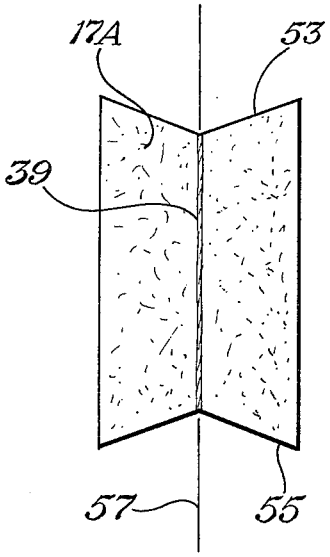
Fig. 10
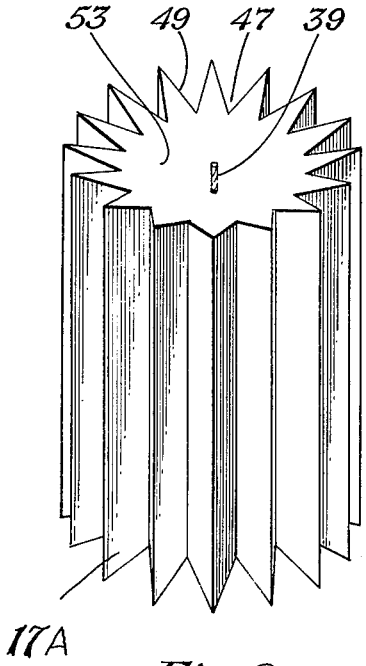
Fig. 8
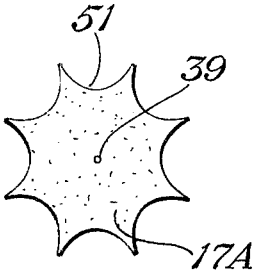
Fig. 11

METHOD AND APPARATUS FOR CONTROLLED FRACTURING OF SUBTERRANEAN FORMATIONS

BACKGROUND OF THE INVENTION

1. Field of the Invention

This invention pertains to controlled fracturing of earth formations. More particularly, this invention pertains to controlled fracturing by explosives and along either horizontal or vertical planes, or both, in a subterranean formation.

2. Description of the Prior Art

It was early determined that advantages could be obtained by fracturing of the earth's formations for a variety of purposes. In seeking to extract hydrocarbons from subterranean formations, the advantages attendant to fracturing became dramatically clear. Early attempts to fracture with explosives resulted in uncontrolled fracturing and destruction of tubing and other goods in the wellbore. Consequently, fracturing by explosives has been all but abandoned except in large diameter boreholes such as for exploding atomic bombs and the like. The controlled fracturing research efforts and development efforts have been directed into the field of hydraulic fracturing in which hydraulic pressure is imposed to create the fractures. Hydraulic fracturing is much less damaging, but is time-consuming and expensive. Moreover, such fractures have not proven to be as controllable as desired, nor able to be maintained within a desired strata or portion of the formation. On the contrary, the fractures have tended to orient themselves into the less desirable zones. For example, fractures have tended to become vertical and enter water producing zones or gas producing zones undesirably.

With the emphasis on the development of hydraulic fracturing, the explosives in a wellbore have been relegated to the areas of cutting off tubular goods, or jet perforating through tubular goods, and the like.

Thus, it can be seen that the prior art has not provided a method of controlled fracturing in a predominantly oriented plane or planes of the earth's formations for a variety of purposes.

SUMMARY OF THE INVENTION

Accordingly, it is an object of this invention to provide method and apparatus for controlled fracturing by explosives in a predominantly oriented plane or planes in the earth's formation for a variety of purposes; for example, the fracturing being oriented in substantially horizontal planes or in substantially vertical planes.

It is a specific object of this invention to provide method and apparatus for controlled fracturing by explosives in both horizontal and vertical planes that extend radially outwardly from a borehole penetrating into a portion of the earth's formation to be fractured, while obviating the disadvantages of the prior art.

These and other objects will become apparent from the following descriptive matter, particularly when taken in conjunction with the appended drawings.

In accordance with one embodiment of this invention, controlled fracturing of a portion of the earth's formation intermediate predetermined depths is effected by the following multi-step method.

A. A borehole is formed from the surface of the earth to the lowermost of the predetermined depths defining the portion of the formation.

B. An elongate explosive charge is positioned adjacent the portion of the formation to be fractured. The elongated explosive charge has on its exterior, a plurality of grooves that are symmetrical and deep enough to effect a concentration of explosive forces along a plane encompassing the longitudinal axis of the groove so as to effect a fracture extending radially outwardly from the center line of the longitudinal axis of the grooves. The grooves on the elongate explosive charge are disposed along one of the following configurations for effecting the respectively described fracture orientations.

i. The grooves are longitudinally extending for effecting predominantly vertically oriented fractures along predetermined vertical planes extending radially outwardly from the center line of the borehole and the charge therewithin.

ii. A plurality of peripherally disposed grooves extending peripherally around the elongate explosive charge with the center line of the groove lying in respective planes that are substantially perpendicular to the central longitudinal axis of the charge for fracturing in horizontal planes when positioned adjacent the portion of the formation to be fractured.

The one or more explosive charges are detonated to fracture along the predetermined plane as determined by the nature and orientation of the grooves. Preferably, for most general purposes wherein a high degree of fracturing is desired, both vertically-and horizontally-fracturing charges are lowered into the well in succession and detonated successively. Either type of charge may be employed first and various sequences may be employed to achieve the desired results.

In another embodiment, this invention provides the apparatus for effecting the controlled fracturing, and includes the detonation means, the surface equipment, the elongate interconnection between the detonation means and the surface equipment, as well as the explosive charge for positioning adjacent the portion of the earth's formation to be fractured.

In the descriptive matter hereinafter, the term "horizontal" is employed to mean substantially parallel with the natural central plane of the formation and the term "vertical" is employed to mean substantially perpendicular to the natural central plane of the formation. Where the pitch or slope of the geologic formations or strata vary significantly from the horizontal, directional drilling may be used to effect boreholes at right angles, or normal, to the natural planes of the formation (instead of vertical boreholes). The fractures then are "normal" fractures, referred to as "vertical" fractures; and "planar" fractures, referred to as "horizontal" fractures.

BRIEF DESCRIPTION OF THE DRAWINGS

FIG. 5 is an isometric view of an explosive charge for creating horizontal fractures in accordance with this invention.

FIG. 6 is a side cross sectional view of the explosive charges of FIG. 5.

FIG. 7 is a side cross sectional view of another embodiment of a charge for creating horizontal fractures and having grooves that are arcuate in cross sectional shape.

FIG. 7A is a partial cross sectional view of the embodiment of FIG. 7 illustrating the concentration of explosive forces and propagation of the forces out into the subterranean formation for creating and propagating the fracture.

FIG. 8 is an isometric view of an explosive charge for creating vertical fractures.

FIG. 9 is a top cross sectional view of the explosive charge of FIG. 8.

FIG. 10 is a side cross sectional view of the embodiment of FIG. 8.

FIG. 11 is a top cross sectional view of another embodiment of an explosive charge for creating vertical fractures and having grooves that are arcuate in cross sectional shape.

DESCRIPTION OF PREFERRED EMBODIMENTS

Figure 1:
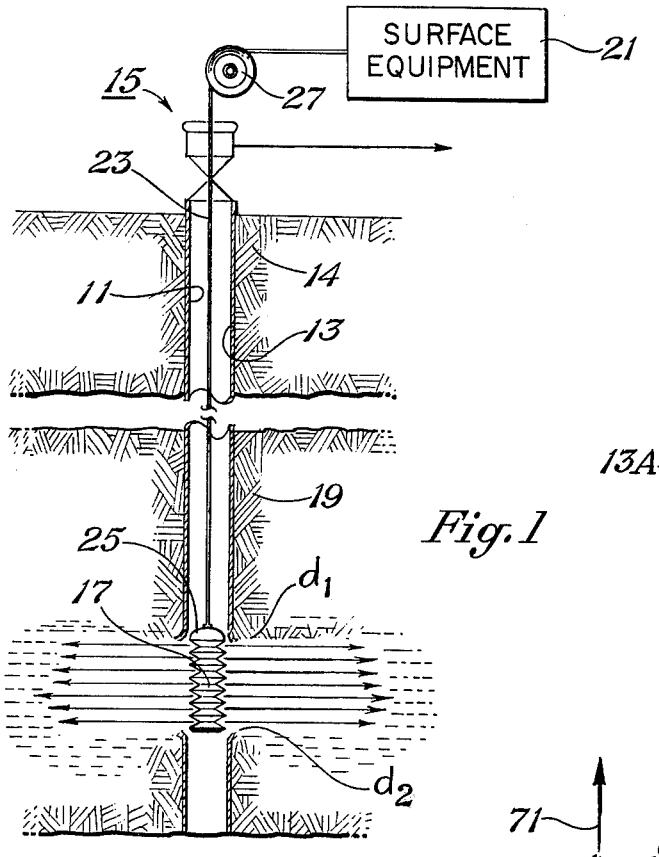
FIG. 1 is a side elevational view, partly schematic, showing one embodiment of this invention emplaced in a borehole penetrating subterranean formations of the earth.

Referring to FIG. 1, there is illustrated a casing 11 in a borehole 13 drilled into the subterranean formations 14. As illustrated, the borehole 13 penetrates through the subterranean formations to expose the portion to be fractured; for example, between depths $d_1$ and $d_2$. The portion of the formation intermediate the depths $d_1$ and $d_2$ is potentially productive of oil or gas in the illustrated embodiment. The upper end of the borehole 13 is fitted with a well completion assembly 15, including the conventional well head adapter, christmas tree (or valves) and lubricator. Frequently in early completion work the casing 11 will not extend to the portion of the formation to be fractured, but will be terminated thereabove. As illustrated, however, the fracturing is done through the casing to illustrate the capabilities of this invention.

An elongate explosive charge 17 is illustrated disposed in the borehole 13 intermediate the depths $d_1$ and $d_2$ adjacent the portion of the subterranean formation 19 to be fractured. The elongate explosive charge 17 will be described later hereinafter in greater detail. The elongate explosive charge is connected with surface equipment 21 via suitable wireline 23 and detonation means 25.

The surface equipment 21, the wireline 23 and the detonation means 25 will be coordinated to achieve detonation of the explosive charge 17 and may take any of the conventional forms. For example, the detonation means 25 may comprise primer and explosive booster charge with means such as jars, and the like for setting off the primer and booster charge, wireline 23 may comprise "slick line", or nonelectrical cable, and the surface equipment may comprise means for effecting a jarring action. Specifically, such a means for effecting a jarring action may comprise controls and motor for effecting abrupt reversal or stopping of the cable fed over pulley 27 over which the wireline 23 is being lowered into the well. Preferably, however, the detonation means 25 will comprise an electrically detonatable charge in conjunction with primacord extending centrally of the explosive charge 17 for effecting substantially simultaneous and instantaneous detonation therewithin; the wireline 23 will comprise an electrical conductor for conducting the electrical signal for detonating the detonation means 25; and the surface equipment 21 comprises equipment for completing an electrical circuit to effect detonation of the detonation means 25, and hence, the explosive charge 17. In any event, the respective detonation means 23 and surface equipment 21 are conventional, as implied in United States patents such as U.S. Pat. No. 2,957,414; do not, per se, form a part of this invention; and do not need to be described in detail herein.

Figure 2:
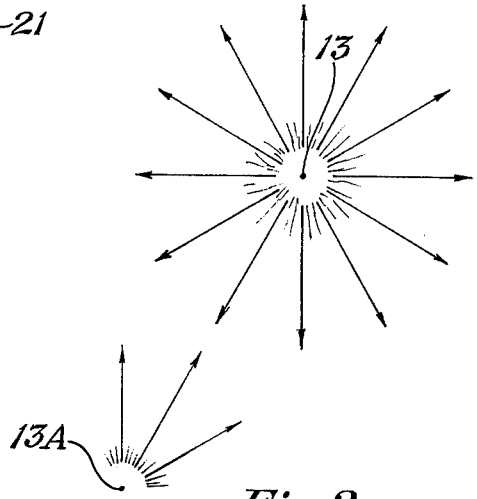
FIG. 2 is a top view depicting fractures extending between wells in a pattern.
Figure 3:
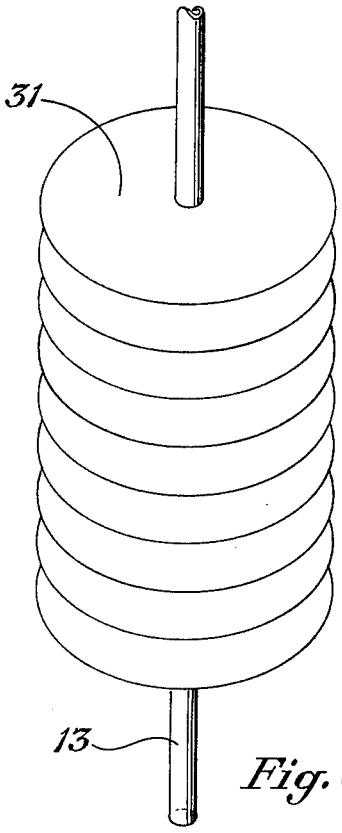
FIG. 3 is a schematic view of horizontal planes of fracture emanating from a borehole.

When fracturing outwardly from a borehole at the portion of the formation to be fractured, the explosive charge is detonated and force created that is greater than the pressure of the formation at that depth plus the tensile strength of the formation so as to create the fracture. Desirably, these forces will extend out into the formation along one or more of the horizontally oriented or vertically oriented planes 31 or 33, FIGS. 3 and 4. Preferably, as illustrated in FIG. 2, the respective fractures will extend radially outwardly from the boreholes 13 and 13A to intersect with each other in the order to obtain the most efficient production of the fluid, be it oil or natural gas, from the borehole.

For fluid production without adjacent undesirable water-containing formations, it is ordinarily preferable that the fracturing is accomplished in planes at right angles to one another; that is, in both the horizontal and vertical planes; for most efficient production of fluid from the formation into the borehole 13 and, hence, through the well completion assembly 15 at the surface. By this invention, the planes of the fractures are contained between the upper and lower planes at depths $d_1$ and $d_2$.

The fracturing is best accomplished in two separate explosions, either of which may be first in order. One creates the normal plane fractures, illustrated by the horizontal planes 31. Accordingly, the shaped charge for effecting such horizontal fractures will be described first.

In general, the elongate explosive charges that are emplaced in the borehole adjacent the portion of the formation to be fractured may comprise any of the conventionally employed explosives that are amenable to shaping of the charge. This includes the high order explosives having a high detonation rate, low order explosives with relatively lower detonation rate, and even the unstable and extremely high powered explosives, such as the liquids and slurries that can be employed in containers having the desired shape. Typical of the explosives having the high detonation rate are trinitrotoluene (TNT), pentaery-thritoltetranitrate (PETN), Cyclotal, dynamite and the like. These explosives may be employed with finely divided inert diluents, such as plaster of paris, salt, powdered glass and the like if desired for cohesiveness. In fact, even organic diluents such as powdered synthetic resins may be employed for cohesiveness.

The respective characteristics of the high order and low order explosives are well known to those familiar with explosives and have been delineated in many publications dealing with explosives. A well known example of such publications is "Detonation and Condensed Explosives" by Jay Taylor, Oxford Press, 1952, London, England. An explanation and discussion herein of the phenomena of these explosives is not necessary, since the publicly available technology such as delineated in Taylor's book is incorporated herein by reference for the details omitted herefrom. Typical of other explosives are the gun powders (mixtures of potassium nitrate, sulfur and charcoal), sodium nitrate mixtures (as class 1 with barium or sodium nitrate in the place of potassium nitrate), potassium chlorate mixtures, gun cottons (nitro compounds), picric acids or its derivatives, sprenge (not explosive but becoming so on the addition of an oxidizing substance and detonator). Typical of the liquid explosives that can be employed is nitroglycerine within an outer container shaped as illustrated in the figures.

The elongate explosive charges 17 have grooves that must be symmetrical with respect to a central longitudinal axis, or plane, in order to obtain the concentration of the forces, such as illustrated in FIG. 7A. The grooves may have cross sectional shapes that have straight sides 35, FIG. 6, or arcuate sides 37, FIG. 7. Referring to FIGS. 5 and 6, the explosive charge 17 has an explosive initiating means, such as primacord 39 in the center and is substantially the same composition throughout the remainder of the charge. As can be seen in FIGS. 5 and 6, the respective grooves 41 are symmetrical with respect to their central longitudinal axis and are disposed peripherally around the explosive charge 17 for creating a resultant force in a horizontal plane and fracturing the portion of the formation to be fractured. The resultant force is created locally by the joinder of the respective forces at right angles to the face of the grooves 41. The force generated by the joinder of forces normal to the surfaces, or sides 35, of the grooves 41 has been estimated to be in magnitude in excess of 50 million pounds per square inch (psi). As the force expands out into the formation, it is diminished but is still great enough to created the fracture for many feet out into the formation around the wellbore.

In the alternate embodiment having the arcuate sides, the forces come together at the center, particularly where the arcuate shape is parabaloid, as illustrated in FIG. 7A, to generate a resultant force shown by arrow 43 that is similarly highly effective in propagating a horizontal fracture out into the subterranean formation about the wellbore.

Figure 4:
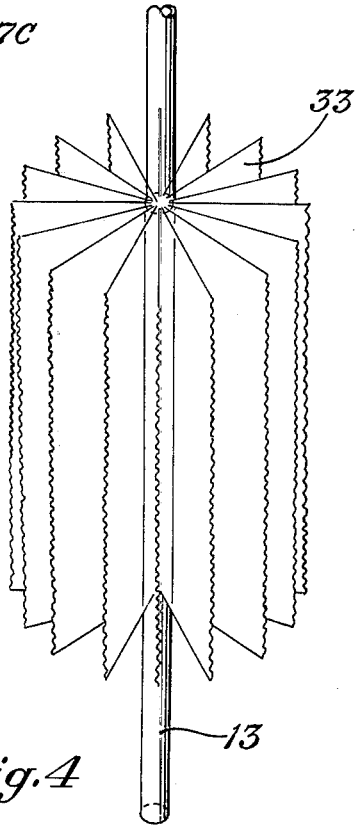
FIG. 4 is a schematic view of vertical planes of fracture emanating from a borehole.

FIGS. 8–11 illustrate another embodiment of this invention in which the elongate explosive charge has its grooves extending longitudinally thereof for propagating fractures in the vertical plane, as illustrated in FIG. 4. Specifically, the charge 17A, FIGS. 8–11, has its respective plurality of grooves 47 disposed evenly around its outer periphery and traversing longitudinally thereof. It has the primacord 39. As illustrated in FIGS. 8 and 9, the respective grooves 47 have straight sides 49. If desired, on the other hand, the respective grooves may have arcuate sides 51, as illustrated in FIG. 11. As described hereinbefore, however, it is imperative that the grooves be symmetrical with respect to a central longitudinal axis, or plane, in order to afford a concentration of the forces necessary to effect the fracture. Otherwise, the forces are disrupted and dissipated as in a conventional explosion.

As can be seen in FIGS. 5–8 and 10, both the horizontal fracturing charges 17 and the vertical fracturing charges 17A have respective symmetrically dished tops 53 and bottoms 55. This structure is beneficial at either or both of the top and bottom in that it causes the explosive force to be directed inwardly the center line 57 and be directed centrally of the borehole 13 in the respective upward and downward directions. When both are employed, the resultant reactive force is neutralized, so there is no tendency to move the charge 17, or change its depth in the borehole.

In addition, the configured bottom 55 may serve to extend the fracture downwardly if emplaced adjacent, or near the bottom of the borehole. If penetration downwardly is to be minimized, a flat bottom may be used. Still further reduction can be achieved by rounding off the bottom as a semi-spherical shape. The latter will cause most of the downward force to be expended in local pulverization of material.

Figure 12:
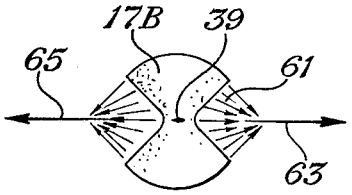
FIG. 12 is a top cross sectional view of an explosive charge for creating a succession of line fractures when each of the explosive charges are emplaced in aligned wellbores.
Figure 13:
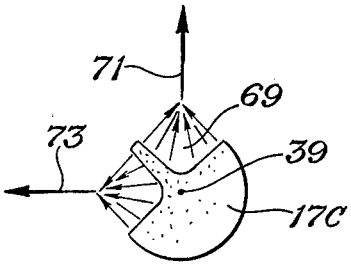
FIG. 13 is a top cross sectional view of an explosive charge for creating fractures at 90° to one another.

In general, the force generated by the merging forces on the groove will be proportional to the distance from tip to tip of the respective grooves. Thus, relatively few grooves may be employed, such as illustrated in FIG. 11 to obtain a greater force and, hence, a greater depth of fracturing; or many grooves, as illustrated in FIG. 9, may be employed to obtain many fractures of relatively lesser extent out into the formation. In fact, as illustrated in FIGS. 12 and 13, in-line fracturing, as well as fracturing at 90° becomes feasible. As illustrated in FIG. 12, the explosive charge 17B, with primacord in the center, has two notches, or grooves 61, formed on diametrically opposite sides for providing respective fracturing forces indicated by the arrows 63 and 65 for in-line fracturing, as between wells. In the explosive charge 17C of FIG. 13, the respective grooves 69 are oriented at 90° to each other so that the imploding forces join to form fracturing forces at the respective 90° angle to each other, indicated by the arrows 71 and 73.

In operation, a borehole is formed from the surface of the earth to at least the lowest of the predetermined depths, such as $d_2$, so as to allow at least one resultant explosive force to be directed against the portion of the formation to be fractured. Thereafter, there is lowered into the borehole until opposite the portion of the formation, the elongate explosive charge 17. The elongate explosive charge is selected so that each grrove is in a plane that is oriented as the fractures are to be propagated. For example, each groove will have a horizontal orientation when suspended in the wellbore where its respective horizontal fracture is to be effected. On the other hand, the explosive charge will have its grooves oriented vertically for propagating fractures in a vertical plane. Thereafter, the explosive 17 is detonated, as by closing a switch in the surface equipment 21 if an electrical detonation means is employed as illustrated. Specifically, the primacord 39 is detonated interiorly of the charge to initiate detonation. The detonation wave passes rapidly outwardly through the charge. The explosive forces are extended normal to the peripherally outermost surfaces of the charge. When the grooves are encountered, these forces are extended inwardly toward the symmetrical center line of the grooves to join with the other forces and generate the force of extremely large magnitude, indidated by arrow 43 of FIG. 7A. Consequently, the formation is fractured. As illustrated in FIG. 1, the horizontally fracturing charge 17 is first detonated in the borehole to fracture outwardly into the subterranean formation. Where there is casing, the explosive force cuts through the casing and outwardly into the formation. Where the utomost efficiency in production of fluid is desired, it may be advisable, and ordinarily is, to thereafter lower into the desired depth opposite the portion of the formation a charge 17A with the vertically oriented grooves for thereafter fracturing in the vertical plane. The charge 17A is detonated to extend the vertical planes out into the formation. If desired, the sequence of either or both charges may be detonated again in the formation to increase the degree of fracturing. Ordinarily, however, this will not be necessary, since the fractures have been extended up to 50 to 150 feet out into the formation about the wellbore with this invention. These fractures were obtained with dynamite. It is belived that even greater depths can be obtained with more powerful explosives, such as nitroglycerine or PETN.

Thereafter, the detritus such as any spent mechanical material from holding the charge, the cable 23, and the like is removed from the wellbore and production begun. If desired, other debris, such as broken rock and the like, may be baled from the borehole before production is begun. On the other hand, if desired, the wellbore may be suitably packed off, filled with packing material, gravel, sand or the like to prevent shifting of the face of the formation during production. Any of the other conventional production technology may be employed to optimize production rates for a given borehole in which the fracturing has been done.

The following example illustrates one embodiment of this invention.

EXAMPLE

In a gas field in which the producing formation is known to contain relatively high porosity but has such low permeability as to be commercially infeasible for production, the formation is fractured to increase the rate of productivity.

Dynamite charges having the delineated shapes for respective horizontal and vertical fracturing are successively lowered into the well opposite the portion of the formation to be fractured and the charges are detonated, respectively. The length of the charges are such that the desired thickness of the formation would be fractured. For example, in one formation, the thickness is a 10 foot section of producting formation at a depth of about 1,000 feet. The gas wells are 4 ½ inch cased gas wells in that field. Following detonation of the explosives, flow tests are conducted to determine if sufficient flow stimulation has been achieved. Further increases in production rate can subsequently be achieved, either at this time, or later on, by conventional hydrofracturing or acidulation. The controlled fracture latticework would allow improved effectiveness of those techniques.

From the foregoing, it can be seen that this invention provides a method of controlled fracturing, economically and employing explosives, without having to advert to the time consuming and expensive hydraulic techniques requiring expensive equipment to set on a well for a prolonged interval. The method and apparatus of this invention portend widely useful applications such as the following.

1. This invention will enable controlled fracturing of geothermal hot rocks such as the deposit near Marysville, Montana. If the formation can be adequately fractued, it will allow water injection into the mass of rock followed by subsequent production of steam or other pressurized vapors to produce power.

2. This invention will allow controlled fracturing of geothermal steam or hot water deposits which have too low a permeability to sustain useful and practical flow rates from the formation. If these hot rocks can be adequately fractured over a sufficiently great area, or volume, then flows can be obtained that will support power generation plants and conserve energy.

3. This invention will allow controlled fracturing of host rock formations containing geo-pressurized hot water and gas. Successful massive fracturing of these host rocks may be required to obtain and sustain sufficient flow rates to become economically feasible as energy sources.

4. This invention will allow controlled fracturing of gas-containing host rock formation. The American Gas Association reports that one area in the western United States contains several trillion cubic feet of gas. Attempts to recover it by nuclear exposion have not been successful, practical, or economically feasible. If this rock can be thoroughly fractured to open up collection channels, gas can be recovered for commerical use.

5. This invention will allow controlled fracturing of host rock for primary, secondary and tertiary recovery of crude oil or oil and gas from petroleum deposits. Many wells which will not yield sufficient flow to be economically useful may become productive after the host rock has been extensively fractured.

6. This invention will allow controlled fracturing of oil shale formations. The in situ recovery of shale oil from oil shale may well be dependent upon the technology required to effect controlled massive fracturing of the shale in place.

7. This invention will allow controlled fracturing of coal deposits for gas recovery. Great quanities of methane and associated gases may be recovered from coal deposits. The amount recoverable could be dramatically increased by controlled fracturing to free the gas to flow from isolated pockets to one or more recovery wells.

8. This invention will allow controlled fracturing of coal deposits for mine safety. Since gas explosions are the greatest coal mine safety hazards, it should be most desirable to maintain a flow of gas and air away from the mine openings, such as rooms, tunnels and the like. This can effectively be done by use of controlled fracturing and gas withdrawal.

9. This invention will allow controlled fracturing of coal deposits for in situ recovery. Specifically, the coal may be burned in place to produce various gas mixtures of carbon monoxide, carbon dioxide, hydrogen and various hydrocarbons. Control of the process has historically been most difficult. Controlled fracturing will allow effective control of the process and may, therefore, make it a commercially feasible means for producing gas, chemical by-products and methyl fuel or methyl alcohol from coal. Very deep deposits which would otherwise be uneconomical to recover can thus be utilized. Thin layered deposits containing too much gangue material to be mineable can also be recovered in this manner.

10. This invention will allow controlled fracturing of ores for leaching-mining operations. Many ores are amenable to chemical leaching, sometimes called solution mining. In this process, leach liquors or solutions must permeate the ore body in order to dissolve the desired minerals and remove them in liquid form from the host rock. Controlled massive fracturing can greatly enhance the usefulness of this process.

11. This invention allows controlled fracturing of ice for iceberg control. Specifically, this invention allows controlled fracturing to virtually disintegrate huge ice formations with a small amount of explosive. The mass may also be broken into controlled size blocks as desired.

While we have not attempted to employ it, it is believed that a helical arrangement in which the grooves are formed into the explosive charge 17 similarly as threads are formed on a bolt could be effective. Control of individual fractues is better when the discrete and coplanar grooves are employed, however, rather than the helical, or thread type, grooves are employed.

This invention has been described primarily with respect to controlled fracturing of subterranean formations, it can be employed, also, to fracture exposed portions of formations that may have been previously worked, such as outcroppings of coal mines and the like. Consequently, the terminology employed is employed in its broad sense to read on such fracturing of exposed portions of the earth's formations, whether or not they be subterranean at the time of the fracturing.

The invention is, of course, applicable with fracturing angles other than horizontal and vertical. As noted hereinbefore, the horizontal and vertical combination is described for simplicity and clarity in explanation. Directional control of the fracturing zone, which is essentially a right-circular-cylindrical section about the borehole, is effected by proper orientation of the borehole with respect to the formation. Where geologic formations, or strata, are dipping, or pitching, with respect to the horizontal plane, directional drilling may be used to effect penetration of the strata to be fractured at right angles to the planes of the upper and lower strata boundaries. The fracturing then is radiating planes parallel to the borehole centerline and lying between two planes which are at right angles to the borehole centerline and fixed in position by the upper and lower ends of the explosive charge or charges. The circular fracturing planes which are at right angles to the borehole centerline are also within the confines established by the upper and lower ends of the explosive charges.

From the foregoing, it can be seen that this invention achieves the objects delineated hereinbefore and obviates the disadvantages of the prior art. Specifically, this invention enables controlled fracturing by use of explosives, heretofore infeasible in the prior art.

Although this invention has been described with a certain degree of particularity, it is understood that the present disclosure has been made only by way of example and that numerous changes in the details of construction and the combination and arrangement of parts may be resorted to without departing from the spirit and the scope of this invention.

What is claimed is:

1. A method of controlled fracturing of a portion of subterranean formations intermediate predetermined depths comprising the steps of:

a. forming a borehole from the surface of the earth to at least the lowest of said predetermined depths so as to allow an explosive charge to be directed against said portion of said formation at said borehole;

b. lowering into said borehole until opposite said portion of said subterranean formation an elongate explosive charge having substantially uniform composition throughout and having a plurality of grooves on its exterior; each of said grooves being deep enough to effect a concentration of explosive forces along the longitudinal axis of said groove so as to effect a fracture extending radially from the center line of the longitudinal axis of said groove; said elongate explosive charge grooves being disposed along one of the following configurations: a plurality of longitudinally extending grooves for effecting vertical fractures along predetermined planes extending radially from the center line of said borehole; and a plurality of peripherally disposed grooves extending peripherally around said elongate explosive charge for fracturing in respective horizontal planes; said peripherally disposed grooves being in planes substantially perpendicular to the center line of said borehole;

c. detonating said explosive charge at only the ambient pressure in said borehole free from superimposed hydraulic fracturing pressure to fracture simultaneously and solely by explosives to the total radial extent desired along said predetermined planes as determined by the nature of said explosive charge and its oriented grooves such that an explosive force in excess of that required to fracture said formation is generated along each plane and said formation is fractured in the respective planes extending radially out-wardly from said borehole.

2. The method of claim 1 wherein:

a. a vertically-fracturing elongate explosive charge having a plurality of longitudinally extending grooves are lowered into said borehole until opposite side portion of said subterranean formation;

b. said vertical fracturing elongate explosive charge is detonated to fracture said portion of said subterranean formation along a plurality of vertical, radially extending planes;

c. a horizontally-fracturing elongate explosive charge is lowered into said borehole until opposite said portion of said subterranean formation for effecting fractures substantially perpendicular to the center line of said borehole and extending in a substantially horizontal plane therefrom; and d. said horizontally-fracturing elongate explosive charge is detonated to fracture said portion of said subterranean formation along a plurality of said horizontal, radially outwardly extending planes.

3. The method of claim 1 wherein the detritus is removed from said borehole and said steps are repeated.

4. Apparatus for controlled fracturing outwardly from a borehole penetrating a portion of the earth's formation between predetermined depths and in respective planes of predetermined orientation comprising:

a. detonation means for detonating an explosive charge in a borehole;

b. surfaced equipment for effecting control of said detonation means;

c. elongate interconnection between said detonation means and said surface equipment for allowing said detonation means and an explosive charge to be positioned adjacent said portion of said earth's formation; said elongate interconnection being connected with said detonation means and with said surface equipment; and d. an elongate explosive charge operably connected with said detonation means for being positioned and detonated opposite said portion of said formation; said explosive charge having a substantially uniform composition throughout and having a plurality of grooves disposed in a predetermined array on the exterior thereof such that each said groove has its respective central longitudinal axis disposed in the respective said plane along which a fracture is to be propagated; each said groove being deep enough and shaped to effect a concentration of explosive forces along a plane extending radially outwardly from said central longitudinal axis so as to effect a fracture extending radially outwardly in said formation from said center line of said longitudinal axis of said groove; said grooves being symmetrical with respect to their said central longitudinal axes and operable to effect at only the ambient pressure in said borehole free from superimposed hydraulic fracturing pressure a plurality of fractures simultaneously and solely by explosive along said plurality of planes to the total radial extent desired.

5. The apparatus of claim 4 wherein said grooves comprise rings that are disposed peripherally around said explosive charge in respective planes that are substantially perpendicular to the central longitudinal axis of said explosive charge for fracturing in respective horizontal planes extending outwardly from said borehole.

6. The apparatus of claim 5 wherein said grooves are arcuate in cross sectional shape.

7. The apparatus of claim 6 wherein said grooves are parabolic in cross sectional shape.

8. The apparatus of claim 4 wherein said grooves comprise longitudinal grooves with their center lines in respective radially outwardly extending planes; said center lines of said grooves being substantially parallel with the central longitudinal axis of said explosive charge.

9. The apparatus of claim 8 wherein said grooves are arcuate in cross sectional shape.

10. The apparatus of claim 9 wherein said grooves are parabolic in cross sectional shape.

11. The apparatus of claim 4 wherein said explosive charge has a symmetrical recess in each of the top and the bottom so that the upward and downward forces are directed centrally upwardly and downwardly within said borehole to be attenuated with distance, to minimize destruction in said borehole, and to neutralize any reactive force that would tend to move said explosive charge.

* * * * *